US006152188A

United States Patent [19]

Barlasov

[11] Patent Number: 6,152,188

[45] Date of Patent: Nov. 28, 2000

[54] CRIMPING DEVICE

[75] Inventor: Pavlo Barlasov, San Jose, Calif.

[73] Assignee: Teknika USA, Inc., San Jose, Calif.

[21] Appl. No.: 09/289,456

[22] Filed: Apr. 9, 1999

[51] Int. Cl.[7] ..... B21F 15/06

[52] U.S. Cl. ..... 140/153

[58] Field of Search ..... 140/93.2, 93.4, 140/150, 152, 153, 154

[56] References Cited

U.S. PATENT DOCUMENTS 1,784,213 12/1930 Westphal ..... 140/153

FOREIGN PATENT DOCUMENTS 28 21 822 11/1979 Germany ..... 140/93.4

*Primary Examiner*—Lowell A. Larson
*Attorney, Agent, or Firm*—The Kline Law Firm

[57] ABSTRACT

A crimping device constructed with a plurality of shares bent in a middle section with offset pairs of jaws mounted thereon. The bent shape of the shares allows offsetting the opposing rows of jaws so that they overlap without interference. This means that each of the jaws can be identical in conformation. When closed on a seal, the crimping device creates a staggered pattern of multiple crimps so that a maximum interior surface area of the seal is pressed into the band being sealed. The working surface of the shares is shaped as an arch so that when used in conjunction with the uniquely shaped working surfaces of the jaws, the device causes the seal to be arched upward during the crimping operation. This arching further increases the rigidity and holding strength of the seal to be formed.

11 Claims, 4 Drawing Sheets

CRIMPING DEVICE

FIELD OF THE INVENTION

The present invention relates generally to banding equipment, and more particularly is a crimping device.

BACKGROUND OF THE INVENTION

Banding tools are used to secure articles in a bundle, or to bind packages. After it is tightened, the band is held in position by a seal that is crimped on the band. The seal, particularly if it is intended for use on a plastic band, has a plurality of teeth on its inner surface. When the seal is crimped around the band, the teeth in the seal penetrate the surface of the band to assure that the band is held securely within the seal.

There exist prior art crimping devices that comprise sets of opposing short and long jaws pivotally mounted on a set of flat shares. The row of short jaws bends and closes a short side of a seal, and the row of longer jaws bends and closes a long side of the seal. When performing a crimping operation, the jaws press the seal against the flat shares and create several corrugations on the seal. The corrugations formed help the teeth of the seal to penetrate deeper into the band, thereby increasing the holding strength of the seal. Further, the series of corrugations increases the rigidity of the seal.

The prior art devices are subject to three main disadvantages: (1) The jaws of the row that bends and closes the long side of the seal must be formed with a relatively long extended ends that are unsupported. That does not allow to develop a closing force on an extended ends of the jaws that is required for sufficient closing a seal. (2) The unsupported long ends of jaws are under a heavy load, and therefore prone to frequent breakage. (3) Due to the fact that the jaws of opposing rows have different shape, the operator must place the device in one required orientation to properly close the seal.

Accordingly, it is an object of the present invention to provide a crimping device that more efficiently closes a seal on a plastic band.

It is a further object of the present invention to provide a device that more effectively spreads the forces generated during the crimping operation, and thereby to reduce the tendency of the crimping jaws to break.

It is a still further object of the present invention to provide a device that requires minimal force to be applied by the operator, and does not require the operator to place the device on the seal in one specific orientation.

SUMMARY OF THE INVENTION

The present invention is a crimping device comprising a plurality of bent shares with an offset pair of crimping jaws. The bent center portion of the shares allows all of the crimping jaws to be identical in conformation. When closed on a seal, the crimping device creates a staggered pattern of crimps in the seal so that a maximum interior surface area of the seal is pressed into the band being sealed. Since the interior of the seal includes a plurality of teeth, the greater surface area being crimped results in a greater number of the teeth in the seal penetrating the surface of the band. This increases the strength of the seal as compared to the prior art devices.

The shares also include an arched working surface. The arch in the working surface of the shares coupled with the unique shape of the jaws causes the seal to be arched upward during the crimping operation. This arching further increases the rigidity of the seal being formed.

An advantage of the present invention is that the shares are bent so that the jaws are staggered, thereby allowing all the jaws to be identical in conformation.

Another advantage of the present invention is that the shares include an arched working surface and the jaws are uniquely shaped so that the seal is arched when it is crimped.

A further advantage of the present invention is that it compresses a greater interior surface area of the seal so that more of the seal's interior teeth penetrate the surface of the band.

A still further advantage of the present invention is that the jaws efficiently apply the crimping force so that there is no weak point subjected to excessive load.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1A:
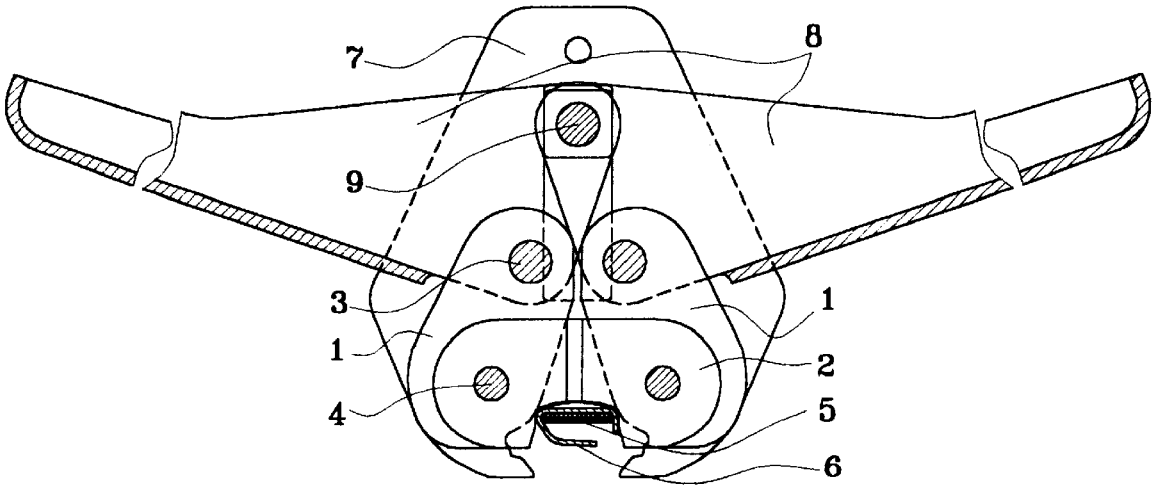
FIG. 1*a* is a partial section view from the front of the crimping device positioned on an open seal.

Referring first to FIGS. 1*a–d*, the present invention is a crimping device comprising a plurality of jaws 1 pivotally mounted on a plurality of bent shares 2 by shafts 4 to form jaw/share units. The plurality of jaw/share units are secured in a housing 7 by shafts 4. The device is operated by a pair of handles 8 pivotally mounted on the housing 7 by a central axis 9 and connected with a plurality of jaw/share units with shafts 4. The crimping device is used to secure a plastic band 5 by crimping a seal 6 on the band.

Figure 1B:
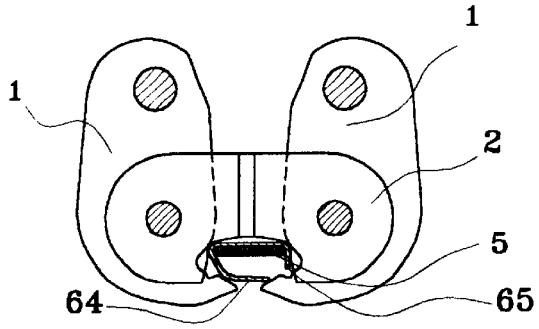
FIG. 1*b* is a partial section view showing the jaws beginning to compress the long side of the seal.
Figure 1C:
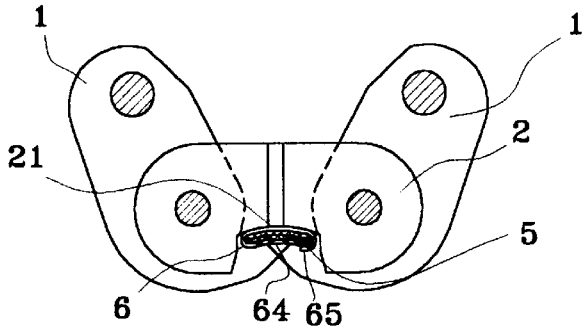
FIG. 1*c* is a partial section view showing the jaws in their closed position, arching the crimped seal.
Figure 2A:
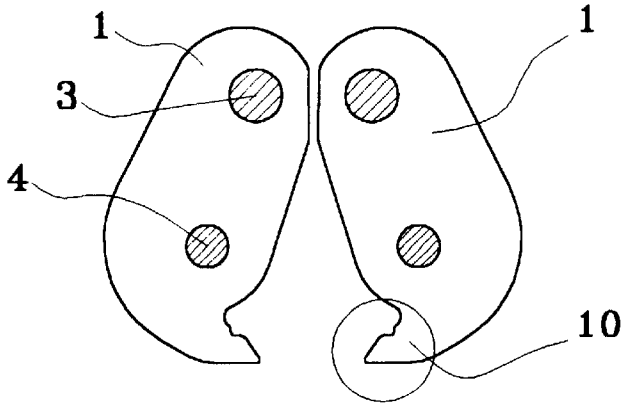
FIG. 2*a* is front view of a pair of jaws.
Figure 2B:
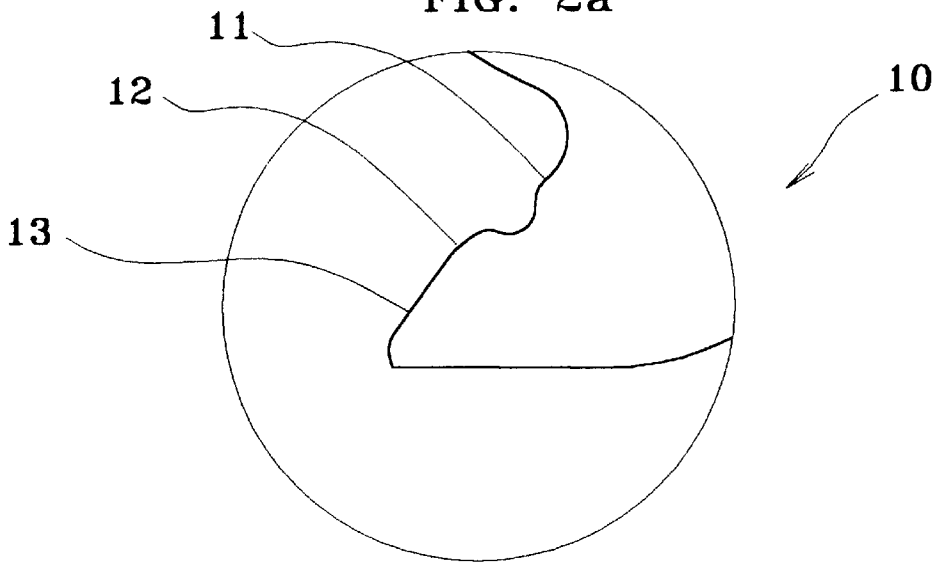
FIG. 2*b* detailed view of the area circled in FIG. 2*a*, the extended end of the jaw.
Figure 2C:
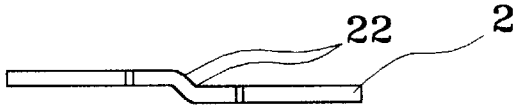
FIG. 2*c* is a bottom view of a jaw share.
Figure 2D:
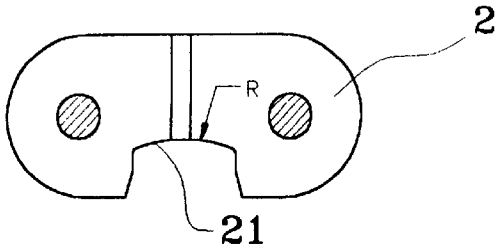
FIG. 2*d* is a front view of a jaw share.

The shares 2 are bent in their middle section as shown in FIG. 2*c*. The bent area 22 allows the opposing rows of jaws to be mounted so that they overlap without interference. This means that all the jaws 1, and all the jaw/share units, are identical in conformation. Due to the fact that all jaw/share units are identical, the following description of one jaw/share unit applies to all jaw/share units. In each jaw/share unit, two jaws 1 forming an opposing offset pair are coupled with one share 2 and mounted on the shafts 4. The jaws 1 pivot about shafts 4 when the handles 8 are closed causing the shafts 3 to spread apart, and the jaw pairs to close. (This motion is depicted in FIGS. 1*a–c*, and is described in further detail below.)

Referring chiefly now to FIGS. 2*a–d*, a working surface of the extended end 10 of the jaws 1 includes three segments. A first segment 11 bends and closes a short side 65 of the seal 6 (FIG. 3*a*) as the jaws 1 are closed. A second segment 12 adds the final closing force to a long side 64 of the seal 6, and a third segment 13 performs the preliminary bending of the long side 64 of the seal 6 (FIG. 1*b*). The working surface 21 of the shares 2 has a radius of curvature (R). Due to the unique shape of the extended ends 10 of the jaws 1, the crimped seal 6 is arched upward against the curved working surface 21 as a result of the crimping operation.

Operation of the crimping device of the present invention is best understood by referring again to FIGS. 1*a–d*. FIG. 1*a* shows the position of the device at the initiation of the crimping operation. It should be noted that due to the symmetrical structure of the jaws 1 of the opposing sides of the device, the operator need not be concerned with the direction of positioning of the device on the seal. That is, there is no distinction between the left and right sides of the device.

Figure 3A:
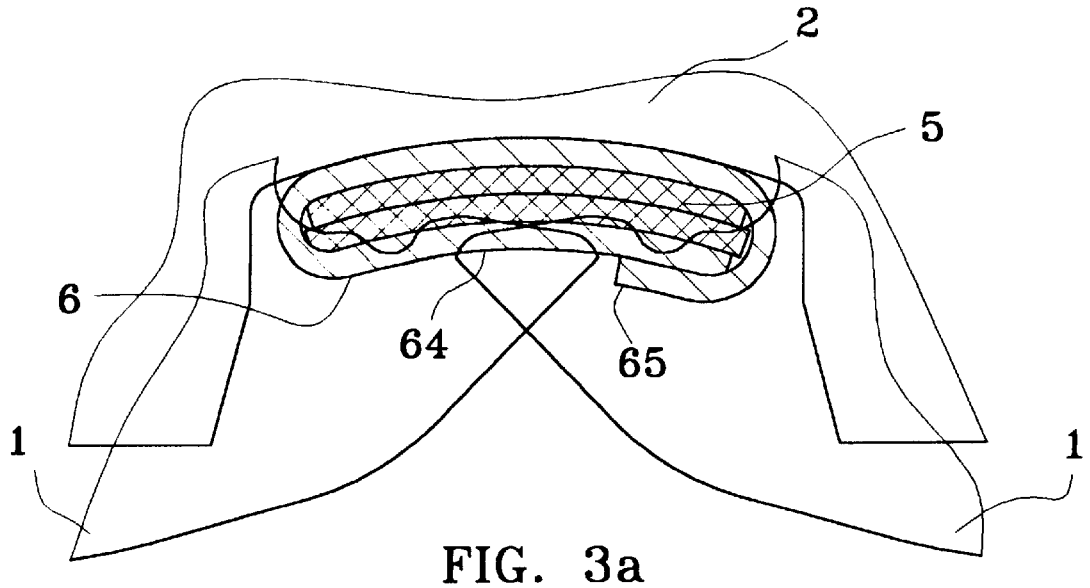
FIG. 3*a* cross section of a crimped seal.

As the jaws 1 begin to close (FIG. 1*b*), segments 13 begin to bend and close the long side 64 of the seal 6 (FIG. 3*a*). As the jaws 1 continue to close, the long side 64 of the of seal 6 is pressed inside the short side 65 of the seal 6. Segments 12 continue to close the seal 6, and as the jaws are completely closed, segments 12 form pressure zones 62 in an inner area of the crimps on the seal 6. At the end of the crimping stroke (FIG. 1*c*), segments 11 form pressure zones 61 in an outer area of the crimps on the seal 6, and fully close the short side 65 onto the long side 64.

Figure 4A:
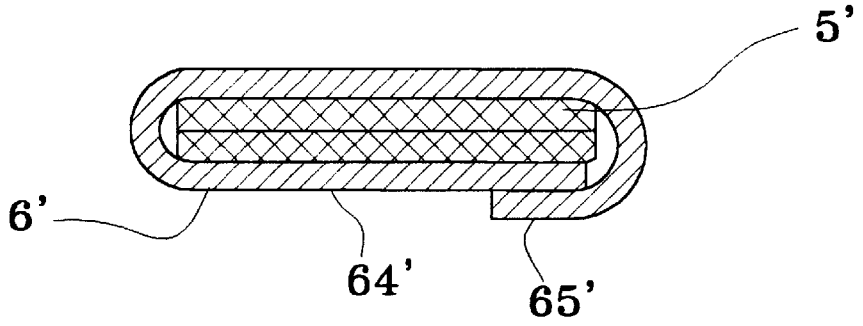
FIG. 4a (Prior art)
FIG. 4*a* is a cross section of a seal crimped by a prior art device.

Due to the curvature of the working surface 21 of the shares 2 and the unique shape of the jaws 1, the seal 6 is arched upward as shown in FIGS. 1*c* and 3*a*. The arching of the seal 6 increases its rigidity and therefore improves the integrity of the joint formed in the band 5. Prior art devices produce a crimped seal that is substantially flat as shown in FIG. 4*a*.

Figure 1D:
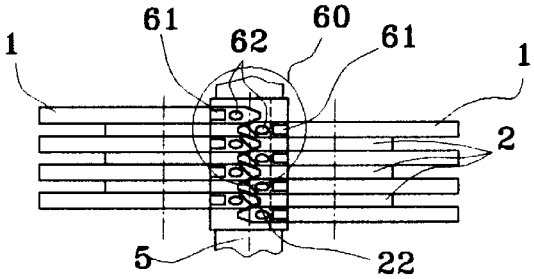
FIG. 1*d* is a top schematic view showing the staggered pattern of pressure zones formed on the seal, with the crimping device in place.
Figure 3B:
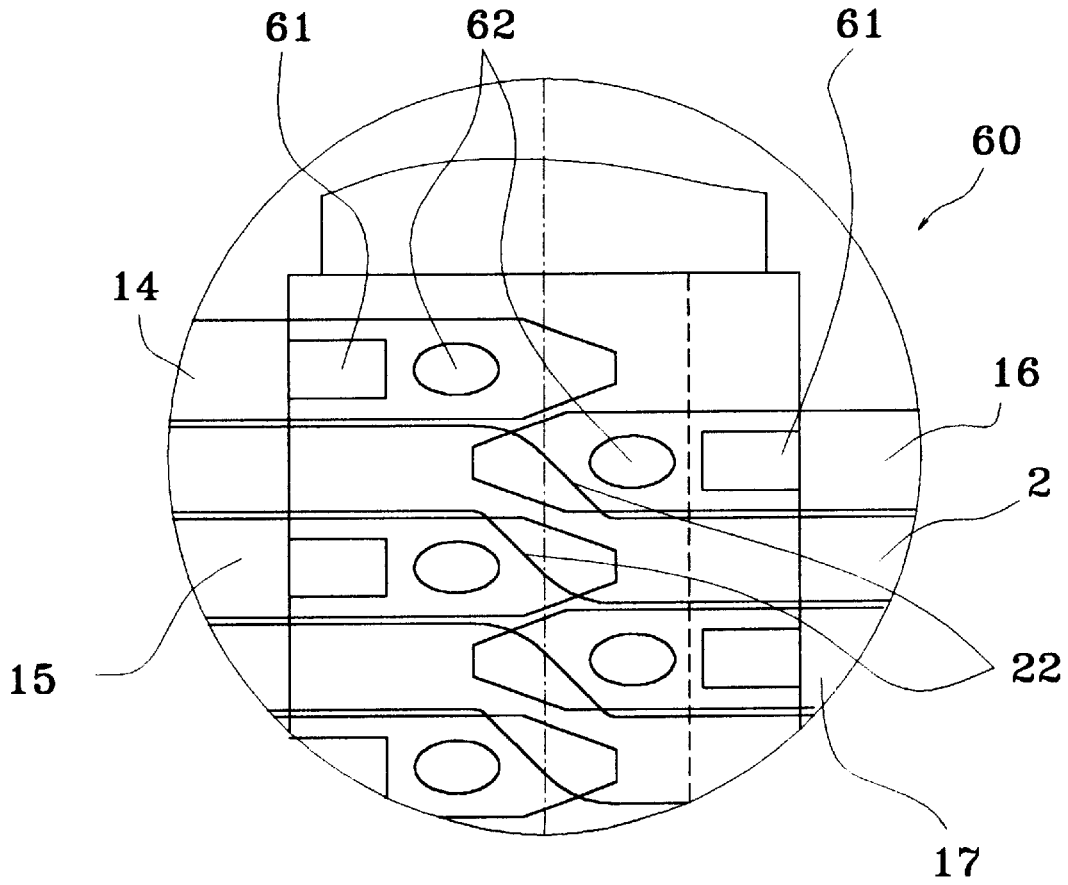
FIG. 3*b* is a detailed view of the area circled in FIG. 1*d* showing the pressure zones formed.
Figure 4B:
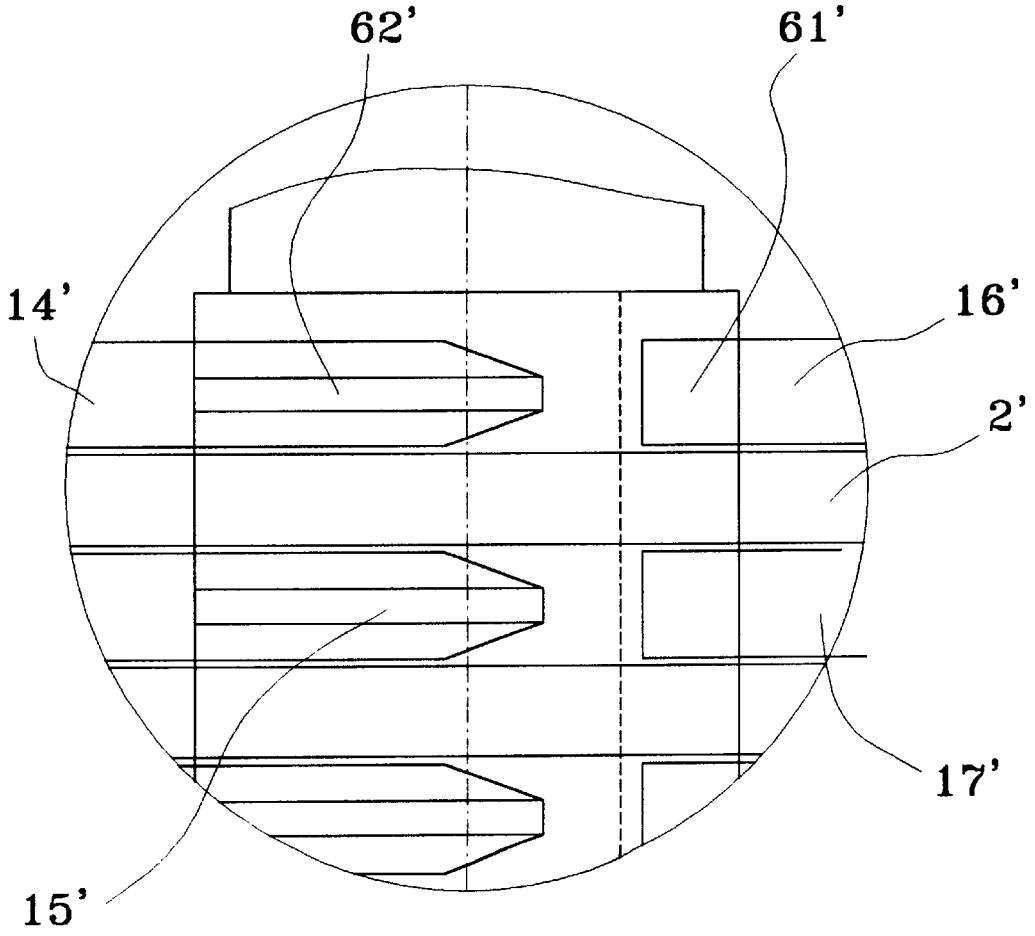
FIG. 4b (Prior art)
FIG. 4*b* is a schematic top view of a seal crimped by a prior art device showing the crimps and the pressure zones formed.

At the final stage of crimping operation the jaws 1 create multiple crimps on the seal by pressing it against the shares 2. The multiple pressure zones 61, 62 formed by the crimping stroke are best illustrated in FIGS. 1*d* and 3*b*. In these figures it is plainly demonstrated that the crimping device of the present invention creates a plurality of crimps not just between jaws 14 and 15 of one side of the device and jaws 16 and 17 of another side, but it also forms multiple additional crimps between jaws 15 and 16 that belong to the opposing sides. These additional crimps can not possibly be achieved by prior art devices (FIG. 4*b*) because they can only form corrugations between jaws 14' and 16' of one jaw/share unit and jaws 15' and 17' of a neighbor jaw/share unit.

The staggering of the jaws 2 in the present invention allows: (1) The creation of multiple additional crimps on the seal, which increases its holding strength. (2) Making the opposing rows of jaws identical in conformation, i.e. no single orientation of the device on the seal is required for crimping. (3) Efficiently distributing the crimping force applied by the operator, without overloading extended unsupported ends of the jaws.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A crimping device comprising:

a plurality of jaw/share units comprising a pair of offset jaws mounted on a bent share, said jaw/share units are pivotally mounted in said device so that said pairs of jaws close when a pair of handles is closed, each said share includes a working surface with a radius of curvature such that the seal is arched upward against said working surface during a crimping operation; wherein said pairs of jaws overlap and mesh when they are closed, such that said jaws form a staggered pattern of crimps in a seal during a crimping operation, thereby maximizing a securing capability of said seal on a band, and wherein said jaw/share units are uniformly disposed across a width of a crimping area, such that said staggered pattern of crimps is symmetrical about a longitudinal center of said seal, thereby enabling said crimping device to close seals loaded in at least two orientations.

2. The crimping device as claimed in claim 1 wherein:

a working surface of an extended end of said jaws includes three segments, a first segment to bend and close a short side of the seal as said jaws are closed, a second segment to apply a final closing force to a long side of the seal, and a third segment to perform a preliminary bending of said long side of said seal.

3. The crimping device as claimed in claim 1 wherein:

a structure of a first jaw in a given pair is identical to a structure of a second jaw in said pair.

4. The crimping device as claimed in claim 1 wherein:

a structure of a given one of said jaw/share units is identical to a structure of all other said jaw/share units.

5. A crimping device comprising:

a plurality of jaw/share units comprising a pair of opposing offset jaws mounted on a share, said jaw/share units are pivotally mounted in said device so that said pairs of jaws overlap and mesh when a pair of handles is closed; wherein each said share includes a working surface with a radius of curvature such that the seal is arched upward against said working surface during a crimping operation, a working surface of an extended end of said jaws includes three segments, a first segment to bend and close a short side of the seal as said jaws are closed, a second segment to apply a final closing force to a long side of the seal, and a third segment to perform a preliminary bending of said long side of said seal; such that said jaws form a staggered pattern of crimps in a seal during a crimping operation, thereby maximizing a securing capability of said seal on a band.

6. The crimping device as claimed in claim 5 wherein:

a structure of a first jaw in a given pair is identical to a structure of a second jaw in said pair.

7. The crimping device as claimed in claim 5 wherein:

a structure of a given one of said jaw/share units is identical to a structure of all other said jaw/share units.

8. The crimping device as claimed in claim 5 wherein:

said crimping device applies a large closing force on a short central segment of said jaws, such that a maximum closing force is applied to the seal using a lever of minimal length.

9. A crimping device comprising:

a plurality of jaw/share units comprising a pair of offset jaws mounted on a bent share, said jaw/share units are pivotally mounted in said device so that said pairs of jaws close when a pair of handles is closed, and a working surface of an extended end of said jaws includes three segments, a first segment to bend and close a short side of the seal as said jaws are closed, a second segment to apply a final closing force to a long side of the seal, and a third segment to perform a preliminary bending of said long side of said seal; wherein said pairs of jaws overlap and mesh when they are closed, such that said jaws form a staggered pattern of crimps in a seal during a crimping operation, thereby maximizing a securing capability of said seal on a band.

10. The crimping device as claimed in claim 9 wherein:

a structure of a first jaw in a given pair is identical to a structure of a second jaw in said pair.

11. The crimping device as claimed in claim 9 wherein:

a structure of a given one of said jaw/share units is identical to a structure of all other said jaw/share units.

* * * * *